United States Patent [19]

Maust, Jr.

[11] 4,230,460

[45] Oct. 28, 1980

[54] METHOD FOR ENHANCING THE UTILIZATION OF POWDERED COAL

[76] Inventor: Edwin E. Maust, Jr., 1209 Marton St., Laurel, Md. 20810

[21] Appl. No.: 956,287

[22] Filed: Oct. 31, 1978

[51] Int. Cl.[2] ..... C10L 5/12; C10L 5/40; C10L 5/00

[52] U.S. Cl. ..... 44/16 C; 44/10 R; 44/1 SR

[58] Field of Search ..... 44/1 F, 16 C, 16 E, 44/26, 10 R, 15 R, 16 R

[56] References Cited

U.S. PATENT DOCUMENTS

| | | | |
|---|---|---|---|
| 3,356,469 | 12/1967 | Stephenson et al. | 44/10 R |
| 4,111,755 | 9/1978 | Ban et al. | 44/1 F |

FOREIGN PATENT DOCUMENTS

| | | | |
|---|---|---|---|
| 249170 | 3/1926 | United Kingdom | 44/26 |

OTHER PUBLICATIONS

The Sulfurtain Process: Trapping Out Sulfur Dioxide While Burning Pulverized Coal by Buttermore, Coal Age, 1975, pp. 148, 149.

*Primary Examiner*—Carl F. Dees
*Attorney, Agent, or Firm*—Lowe, King, Price & Becker

[57] ABSTRACT

This invention proposes the addition of finely divided (powdered) lime, limestone, or dolomite, and flyash or other pozzolonic material, to finely divided coal (such as the product of a coal cleaning plant) to: (a) provide a binder such that the fine coal can easily be formed into durable pellets, agglomerates, briquettes, or other shapes and/or sizes convenient for handling, transporting, or storing using conventional techniques for standard lump coal, and (b) with these same low-cost materials, provide, upon combustion in a furnace or boiler of appropriate design, with or without prior grinding of the formed coal pieces, a highly dispersed sulfur-capturing agent (sorbent) which, because of its large surface area, high degree of dispersal, and initimate contact with burning coal particles, will efficiently remove gaseous sulfur compounds as they are formed during the combustion process.

The lime, limestone, or dolomite incorporated in the binder function also as desulfurzing agents during the combustion process, thereby further minimizing sulfur emissions due to organic sulfur remaining in the cleaned coal; introducing the desulfurizing agent in this form and manner into the combustion chamber provides for highly controllable, highly efficient desulfurization capability and minimum operating problems; and, finally, the potential sulfur pollutants are captured in a form that permits their collection as part of well-established particulate emission (flyash) control procedures which are required anyway, irrespective of coal sulfur content.

1 Claim, No Drawings

METHOD FOR ENHANCING THE UTILIZATION OF POWDERED COAL

BRIEF SUMMARY OF INVENTION

In simplest terms, this invention proposes the addition of finely divided (powdered) lime, limestone, or dolomite, and flyash, to powdered coal (such as the product of a coal cleaning plant) to provide a binder such that the fine coal can easily be formed into durable pellets, agglomerates, briquettes, or other shapes and/or sizes convenient for handling, transporting, or storing, and to provide, upon combustion in a furnace or boiler of appropriate design, with or without prior grinding of the formed coal pieces, a highly dispersed sulfur-capturing agent (sorbent) which, because of its large surface area, high degree of dispersal, and intimate contact with burning coal particles, will efficiently remove gaseous sulfur compounds as they are formed during the combustion process.

The invention thus permits widespread use of physically-cleaned coal because it provides a low-cost way to convert powdered coal into a transportable form (durable pellets, briquettes, etc.); the lime or other alkaline earth material incorporated in the binder functions also as a desulfurizing agent during the combustion process, thereby further minimizing sulfur emissions due to organic sulfur remaining in the cleaned coal; introducing the desulfurizing agent in this form and manner into the combustion chamber provides for highly controllable, highly efficient desulfurization capability and minimum operating problems; and, finally, the potential sulfur pollutants are captured in a form that permits their collection as part of wellestablished particulate emission (flyash) control procedures which are required anyway, irrespective of coal sulfur content.

Only cheap materials (water, flyash, and lime or limestone or dolomite) are used as binder, and the binder is sufficiently versatile and effective that low-cost forming methods (e.g., simple pelletizing) can be used. Hence, the cost associated with converting powdered coal to an easily-transportable non-polluting fuel is minimal. The necessary water may be that left in the coal after cleaning (thus obviating the need to dewater it), and water being the major liquid component allows easy adjustment of consistency as required for proper operation of whatever forming operation is used. Moreover, adjustment of the water and/or binder content allows the use of different forming techniques for producin each instance the most desirable product for each particular user.

DETAILED DESCRIPTION OF INVENTION

A. Introduction

Coal has been mined and burned as a fuel for several centuries, but only recently has coal been emphasized as our most important fossil fuel because of its abundance relative to petroleum and natural gas. Although there are growing pressures to curtail consumption of oil and natural gas by burning coal instead in every application where it is feasible to do so, enforcement of stringent sulfur emission standards severely limits the options available for expanded coal usage on a national scale.

For those facilities which now, or in the future will be forced to, burn coal as a thermal energy source, there are basically only four strategies by which they can expect to meet present or future Federal, State, and city sulfur emission standards: (1) burn naturally-occurring low-sulfur coal; (2) remove sulfur-containing compounds from high-sulfur coal prior to combustion, i.e., precombustion cleaning; (3) burn coal in such a way and/or under such conditions that gaseous sulfur-containing compounds are removed during the combustion process; or (4) remove sulfur-containing compounds from combustion product gases in a separate operation after they have left the combustion zone, before they are discharged to the atmosphere. The last of these is commonly referred to as flue-gas desulfurization (FGD), flue-gas scrubbing, or stack-gas scrubbing. Though all of the sulfur removal strategies are technically feasible, none is presently economically attractive for meeting the low sulfur levels required by Federal, State, and/or local regulations.

Although burning naturally-occurring low-sulfur coal is the most straightforward sulfur control strategy, there are at least two difficulties preventing implementation of this approach on a nationwide scale. First, production capacity for low-sulfur deposits is presently limited and projected to remain so. It has been estimated that low-sulfur coal production would supply less than 44% of anticipated demand in 1980. Secondly, most low-sulfur coal reserves are in the western part of the Nation, far from the midwestern and eastern centers of demand. Using low-sulfur coal east of the Mississippi River incurs substantial transportation costs, and leads to overall power production costs that are comparable to using FGD and local high-sulfur coal. Furthermore, any tightening of air quality standards would virtually eliminate the low-sulfur coal option as a stand-alone strategy, because the best low-sulfur coals can barely meet the present sulfur emission regulations applicable to new steam generating plants.

Precombustion cleaning of coal has been practiced to some degree for many years as a general up-grading treatment, but only recently has it been given serious attention as a strategy for meeting sulfur emission regulations. One of the major sources of sulfur in coal is pyrite which frequently occurs as tiny particles dispersed throughout the coal matrix. Hence, to be cleaned to acceptable levels of sulfur and ash, most coals must be finely ground to liberate pyrite and ash minerals from the coal particles. This operation is followed by separation of the contaminants from the coal by physical (e.g., froth flotation) or chemical processes. Coal cleaning plants now being designed or constructed are capable of processing high-sulfur coal to make a product that is much lower in sulfur and ash content. Depending on the amount and nature of the sulfur in the raw coal (i.e., pyrite vs organically-combined sulfur), many coals can be brought within or close to compliance levels for a relatively low cost per ton of product. The importance of this cannot be overstated, for it may make it possible to meet existing and/or proposed air quality standards at reasonable costs using traditional, local, coal supplies. The problem is that the cleaned coal product is a powder, whereas the existing transportation, handling, and storage systems have been designed to accomodate lump or coarsely-ground coal and are impractical for powdered coal. Thus, the full potential of coal cleaning cannot be effectively applied because the operations (fine grinding) required for optimum sulfur removal produce a product (powder) which cannot be transported and/or stored using the conventional coal-handling systems. Eliminating this impediment is one of the principal objectives of the present invention.

Although the main source of steam for electric power generation in the United States is the central-station public-utility boiler furnace fired with pulverized coal, this coal is not transported from mine to utility in pulverized form. Rather it is transported to and stored at the utility site as larger chunks and pieces, and then pulverized as part of the utility's coal-feed conditioning system. Aside from environmental considerations, there are few disadvantages to burning pulverized coal, and the coal-burning public utilities currently prefer it as a fuel.

Coal can be burned in such a way that the gaseous sulfur-containing compounds formed during the combustion process are removed almost simultaneous with their formation. The technique receiving most research attention at the present time is called fluidized-bed combustion (FBC). Although it is not at this time a commercially-proven technology, it is considered by many to be one of the most attractive of the newer schemes for direct utilization of coal. This combustion technique entails burning crushed (1" or smaller) coal in a fluidized-bed of sulfur-capturing agent such as limestone, lime, or dolomite. The bed is fluidized by the upward passage of combustion air, and gaseous sulfur-containing compounds formed during combustion are removed to a greater or lesser extent by chemical reaction with the bed material. These reactions can be represented as:

(for lime) $CaO+SO_2+\frac{1}{2}O_2=CaSO_4$ (for limestone) $CaCO_3+SO_2+\frac{1}{2}O_2=CaSO_4+CO_2$.

Generally, the calcium sulfate reaction product is formed on the surface of the sorbent (bed) particles, and, when dislodged or broken off by attrition, is elutriated out of the bed and combustion compartment, along with fly ash, particles of unburned coal, and sorbent particles which have become small enough to be entrained in the high velocity exist gas stream. Certain advantages accrue to operating such a combustor pressurized, instead of at atmospheric pressure. In any case, the sulfur present in the feed coal is trapped as a water-insoluble solid (calcium sulfate) which can be filtered out of the stack gases and disposed of or regenerated. The advantages and disadvantages of this sulfur-control strategy are not crucial to the present discussion. What is important to note is that (a) the use of lime, limestone, or dolomite in a fluidized bed as sorbents for sulfur-containing compounds is positively known to be technically feasible; (b) the sorbent acts by way of a chemical reaction between a gas and solid (CaO, for example) and, hence, is heavily dependent upon the surface area and/or extent of contact between the two; and (c) the sulfur in the coal is converted into a solid which, along with generated fly ash and other particulates, can be relatively easily removed from the combustion product gas stream.

It should also be mentioned that direct injection of lime into the fire box of a more or less conventional coal-fired furnace was tried in 1968 (Union Electric Meramac station in St. Louis and the Kansas City P and L Lawrence station) with generally unsatisfactory results. These facilities were, at the time, being operated with lime/limestone FGD scrubbers (see later paragraphs), and many of the problems encountered were associated with plugging and scaling of the scrubber units. There were, however, some operating problems due to plugging of the boiler.

A second objective of the present invention is to use the known sulfur-capturing capabilities of certain materials, e.g., lime, in a highly efficient manner so that, when cleaned coal is burned, the resulting gaseous sulfur compounds originating from the remaining sulfur in the coal (largely in the form of organic sulfur compounds not removed by physical cleaning) are trapped before release of the combustion product gases to the atmosphere.

The fourth sulfur-control strategy, flue-gas scrubbing, is presently being widely publicized as a viable technique for reducing sulfur emissions from coal-burning facilities, especially utility power plants. Although there are at least five FGD processes in various stages of development, only one of them—lime or limestone scrubbing—can be considered commercially proven. In this process, the sulfur-bearing stack gases are contacted, i.e., scrubbed, with a water slurry of either lime or limestone. Reaction of sulfur dioxide with either of these produces an insoluble calcium sulfate sludge which is separated out and discarded. The basic chemical reactions involved are the same as those given previously, the difference being that the sulfur gases are contacted with the lime or limestone in a water slurry, in a piece of equipment separate from the boiler itself. The major problem in the use of scrubbing techniques is their relatively high capital and operating costs. Sulfur dioxide removal efficiencies of 80–95% are possible, with lime slurry being somewhat more efficient than limestone slurry. Available cost estimates indicate that the addition of scrubbing facilities required for 90% sulfur removal at a coal-fired generating plant burning 3.5% sulfur coal would increase the total cost of power by 10% or more. Burning coal having a lower sulfur content would decrease the size of the required scrubbing facilities, and this would correspondingly decrease the cost of sulfur control. In particular, burning cleaned coal could reduce or eliminate the scrubbing requirements—except that present delivery systems cannot accomodate the powdered product from a mine-mouth coal cleaning plant, so each coal-burning facility would have to have its own coal-cleaning plant in order to maximize sulfur removal. Generally, this is not feasible or desirable.

B. Technical Background and Explanation of Invention

The two points of this invention are: (1) a method to cheaply convert powdered coal into a form that can be economically handled or transported with ease, convenience, and little loss; and (2) accomplishing this in such a way, based on fundamental scientific principles and facts, that sulfur emissions accompanying combustion of the prepared coal will be reduced to low levels, probably sufficiently low to eliminate the need for flue gas scrubbing to meet air quality standards. The technical details and bases for these are given in the following paragraphs.

Although the list of materials that have been used or proposed for use as binders for powdered coal is quite extensive, the prior art in this area can generally be characterized by one or more of the following statements.

(a) The additives suggested are mixtures that include or consist solely of materials that are too expensive to consider using for utility or industrial fuel, the scale of use for which (millions of tons per year) is so large that economics are an overriding factor in determining feasibility. Most applications described in existing patents address the manufacturer of shapes, e.g., briquettes or logs, for small-scale uses such as home stoves or fireplaces. The requirements for these latter applications and the scale of use are totally different from the utility/industrial market emphasized in the present patent. Whereas a stove or fireplace fuel selling for 5 cents/pound may be an easily-marketed product, this corresponds to a price of $100/ton which is at least two times higher than a utility company would consider economically acceptable under normal conditions.

(b) Constituents of the suggested binder are themselves deleterious and would create or exacerbate environmental problems if used on a large scale. Lignin sulfonate, for example, is known to be a good binder for many powdered materials. In addition to the fact that its use in the present application would be too expensive, the compound contains sulfur—one of the materials one wishes to eliminate. Magnesium chloride an sodium chloride, both of which have been proposed as binder constituents, would lead to chlorine emissions of serious magnitude if used in power plant fuel. Furthermore, sodium frequently causes problems in powerplants and other large boilers. Asbestos fiber is another example of an undersirable material that has been advocated as a binder constituent.

(c) The suggested binder is a complex mixture of poorly defined materials, such that the product quality control required for serving the utility/industrial market would be difficult to achieve when practicing the art described. A utility power plant fuel supply, for example, must be uniform in both chemical and physical properties over time periods of months and years. Large boilers are, in fact, frequently designed to use a particular coal, with a particular heating value, ash content, and sulfur content that must be maintained within narrow limits carload after carload, month after month. On the other hand, maintaining the same level of reliability and/or reproducibility in a home heating or fireplace fuel (to which most existing patents are directed) would be unnecessary, so that lack of chemical or mineralogical definiteness in binder composition poses no problem in that case. Specifying the composition of a prepared coal fuel using such words as: "clay, earth, pulverized clay, ash, slag, waste, etc." actually used in many existing patents would be intolerable for power plant fuel. Such materials are too unspecific (variable) in regard to their nature, particle size, origin, or chemical or mineralogical composition.

(d) The binder suggested presupposes, or was developed for use with, a forming operation that would be too expensive or otherwise impractical for large-scale utility/industrial use. To a significant degree, a binder must be formulated with some perception of the requirements of the forming operation that will be used. Briquetting, for example, normally involves the application of high compacting pressures, and binders suitable for this type of forming operation may not be suitable in other instances. Forming operations involving the use of high pressures are generally unsuitable for preparing utility fuel, because they are too costly to perform. Only cheap, relatively simple operations, e.g., pelletizing, are economically permissable, and many of the binders proposed in existing patents simply are not effective when so used. Others that have been proposed may work effectively in simple forming operations, but do not confer on the finished product the necessary durability and/or weather resistance required for handling, storing, and transporting formed pieces on a large scale.

Lime is mentioned as a binder constituent in numerous patents. This probably originates from the fact that is is a common material, relatively cheap, and known to have a sticky, glue-like character when it is wetted in powder form. However, of the many patents which mention lime or limestone as a binder constituent, very few of them ascribe any specific function to these materials.

Since lime will spontaneously absorb moisture from the atmosphere, i.e., is deliquescent, simple forming operations in which lime is the only binder material used might not produce formed pieces having as much weather resistance as required in some instances, e.g., transporting over long distances in open train cars, or capable of being stored in large piles outdoors for very long periods of time. However, lime alone may be entirely adequate as a binder material in circumstances where maximum weather resistance is not required, e.g., short hauls, or enclosed storage. Also, to some degree, the weather resistance of the formed coal pieces will depend on the forming technique used to produce them, since loosely compacted pieces will, in general, decrepitate faster than hard, dense pieces.

While lime in almost any form will, when mixed with water and added to powdered coal, provide some degree of cohesiveness, the present invention advocates having the lime as finely ground as economically feasible. This not only maximizes the cohesiveness of the formed coal pieces, but also is essential from the standpoint of maximizing sulfur capture during combustion. (See later discussion.)

Fly ash is a pozzolonic material, meaning it reacts with an alkali in the presence of water at ordinary temperatures to produce a cementitious material. Since fly ash is cheap, abundant, and relatively inocuous from a chemical standpoint, it is a good material to use (with lime) as a binder for fabricating powdered coal into shapes that have maximum durability and weather resistance. The use of lime in conjunction with fly ash, and, more particularly, its use as a material to catalyze the pozzolonic behavior of fly ash, are not mentioned in the existing patent literature relevant to forming compacts, briquettes, pellets, etc., out of powdered coal.

When used as proposed in this patent, lime functions as a binder itself, and as an initiator for a pozzolonic cementing action, and as a desulfurizing agent during subsequent use of the formed coal during combustion.

Almost any finely ground pozzolonic material would serve as well as fly ash in providing the desired binder. The chief advantage of fly ash is that it is readily available and, by its very nature, is already in the form of an extremely finely divided powder.

Having the initially-solid components of the binder (i.e., lime and fly ash) present in the form of a very finely divided powder promotes a high degree of dispersion of them throughout the mix of powdered coal and, hence, maximizes the cementing action desired of a binder.

Upon combustion of the pelletized or otherwise formed coal, it is expected that the cement-like binder will break down, regenerating lime and fly ash in the fire box. The fly ash will be swept out of the furnace by combustion gases and be collected as stack-gas particulates just as when it was originally produced, and the finely divided lime will be available for infurnace desulfurization of combustion gases. Both the reacted and unreacted lime particles would also be swept out of the fire box as entrained particulates, because of their small size. Hence, the usual systems and/or equipment for removing dry particulates from stack gases would serve to collect the products of desulfurization.

The phenomena associated with reaction of sulfur gases with lime or limestone have been extensively studied, especially in connection with the operation of fluidized bed combustors. Although many details remain uncertain, it is clear that one of the controlling factors involved in desulfurization is the surface area of CaO (not $CaSO_4$) available for contact with $SO_2$ in the gas phase; it is these two chemical entities which must be brought together in the presence of oxygen:

$$CaO + SO_2 + \tfrac{1}{2}O_2 = CaSO_4.$$

The observed influence of absorbent particle size and porosity on FBC performance are difficult to rationalize on any other basis.

Given this information, it follows that in order to use lime (or any other sulfur absorbent) in the manner advocated in the present invention, the absorbent should be as finely divided as economically possible, in order to provide maximum in-furnace surface area for reaction with sulfur gases. Whether the finely divided absorbent particles remain attached to the individual coal particles during combustion, or disengage themselves to form a cloud of absorbent particles intermingled with burning coal particles, is largely immaterial. In the former case, the absorbent particles are in direct contact with the point of sulfur-gas generation. In the latter case, a dense cloud of suspended or entrained absorbent particles of extremely small size is the most intimate contact possible between solid and gas. Moreover, having the absorbent particles small enough to be entrained easily promotes desulfurization because the time available for chemical reaction is not then limited to the fire-box residence time of the combustion gases; reaction can continue as the gases pass from the combustion zone to the particulate-removal equipment. This is in contrast to fluidized bed combustion wherein much larger absorbent particle sizes are used for the specific purpose of maintaining them in the combustion zone for long periods of time, i.e., too large to be lost by entrainment in hot gases leaving the fire box. In fact, the undesirable loss of bed material by attrition and entrainment of the resulting small particles is one of the problems presently being addressed in FBC research.

There is evidence that complete sulfation of limestone or dolomite particles occurs to a depth of the order of 10 microns, so a 20 micron particle can be completely sulfated before the buildup of the $CaSO_4$ reaction product blocks the reaction. In the present invention, this is the general order of the particle size envisioned for lime particles. Operating a fluidized bed combustor with the bed material this small would be infeasible.

One of the purported advantages of fluidized bed combustion is that the lower combustion temperatures normally used therein minimize $NO_x$ emissions. If, instead of using fluidized bed combustion, absorbents such as lime or limestone are introduced into the fire box of a more or less conventional pulverized coal boiler, either mixed with the coal or injected separately, controllable and reliable combustion at low temperatures may be difficult to achieve. Coal prepared in the manner suggested in this invention may provide the homogeneous and reliably-consistent fuel needed to achieve controllable combustion temperatures that are lower than would otherwise be possible.

In certain instances, it may be possible or desirable to introduce the pulverized coal mixture into a furnace or boiler in a fluid or semi-fluid state. It is to be understood that the present invention is considered to include the use of a finely divided absorbent (like lime) admixed with pulverized coal, regardless of how the formulated fuel is introduced into the furnace.

C. Discernable Boundaries on Proportions of Ingredients

Although the most preferable formulation of the proposed ingredients cannot be specified completely at this time, there are guidelines that can be used to define reasonable boundaries on the relative amounts of the various materials that might be used.

Straightforward economic considerations dictate using as little additive as will suffice to obtain the desired performance, though, in the present case, the materials other than coal are relatively low in cost. However, the added lime (or limestone or dolomite) and flyash (or other pozzolonic material) will impose an additional burden on the particulate removal system and, for this reason, the amounts of them used should be minimized regardless of their low cost.

For the purposes of this section, water is disregarded as an additive. Its use is anticipated, but it is low in cost and is viewed herein as a variable that would be adjusted to suit each particular situation, e.g., water might be added to adjust consistency of the mix for optimum performance in a particular pelletizing operation, or water might have to be removed from a particular coal preparation plant product in order to achieve a desired condition. In other words, for the present purposes, water is viewed as an operational variable rather than a chemical additive.

Present regulations for stationary coal-burning power plants restrict sulfur dioxide releases to a maximum of 1.2 lb of $SO_2$ per million Btu's of heat input. The maximum permissable sulfur content of the coal burned is thus a function of both the heating value of the coal and the extent or degree of sulfur removal achieved before the release of the flue gases to the atmosphere. The relationship among these three variables is shown in Table 1. Note that, in this calculation, it is immaterial how or where the sulfur in the coal fuel is removed, e.g., flue gas scrubbing or in-furnace removal.

TABLE 1

Maximum % S permitted in coal fuel in order to remain in compliance with emission restrictions of 1.2 lbs $SO_2$/million Btu.

| heating value of coal, Btu/lb | max. permissable sulfur content, wgt. %, for $SO_2$ removal efficiency of: 0% | 50% | 60% | 70% | 80% | 90% |
|---|---|---|---|---|---|---|
| 7000 | 0.42 | 0.83 | 1.04 | 1.38 | 2.06 | 4.04 |
| 8000 | .48 | .95 | 1.19 | 1.58 | 2.34 | 4.58 |
| 9000 | .54 | 1.07 | 1.33 | 1.77 | 2.63 | 5.13 |
| 10,000 | .60 | 1.19 | 1.48 | 1.96 | 2.92 | 5.66 |
| 11,000 | .66 | 1.30 | 1.62 | 2.16 | 3.20 | 6.20 |
| 12,000 | .72 | 1.42 | 1.77 | 2.34 | 3.48 | 6.72 |
| 13,000 | .78 | 1.54 | 1.92 | 2.54 | 3.76 | 7.24 |

TABLE 1-continued

Maximum % S permitted in coal fuel in order to remain in compliance with emission restrictions of 1.2 lbs $SO_2$/million Btu.

| heating value of coal, Btu/lb | max. permissable sulfur content, wgt. %, for $SO_2$ removal efficiency of: 0% | 50% | 60% | 70% | 80% | 90% |
|---|---|---|---|---|---|---|
| 14,000 | .84 | 1.65 | 2.06 | 2.73 | 4.04 | 7.76 |

If lime is used as an in-furnace absorbent for $SO_2$, the minimum amount (i.e., the stoichiometric amount) required in the formulated lime/coal fuel in each instance is shown in Table 2, assuming the maximum permissable amount of sulfur (given in Table 1) is present in the coal in each instance.

TABLE 2.

Stoichiometric lime content of lime/coal fuel if sulfur content is maximum permissable.

| heating value of coal, Btu/lb | Lime content, wgt. %, for in-furnace $SO_2$ removal efficiency of: 50% | 60% | 70% | 80% | 90% |
|---|---|---|---|---|---|
| 7000 | 0.73 | 1.09 | 1.69 | 2.86 | 6.20 |
| 8000 | .83 | 1.24 | 1.92 | 3.25 | 7.03 |
| 9000 | .94 | 1.40 | 2.16 | 3.64 | 7.84 |
| 10,000 | 1.04 | 1.55 | 2.39 | 4.03 | 8.64 |
| 11,000 | 1.14 | 1.70 | 2.62 | 4.42 | 9.42 |
| 12,000 | 1.24 | 1.86 | 2.86 | 4.80 | 10.20 |
| 13,000 | 1.35 | 2.01 | 3.10 | 5.18 | 10.94 |
| 14,000 | 1.45 | 2.16 | 3.32 | 5.56 | 11.70 |

Present air quality standards also limit the emission of particulates to a maximum of 0.1 lb/million Btu. Using the present invention, all (or at least most of) $CaSO_4$ produced by reaction of lime with $SO_2$ will leave the furnace like flyash. The particulates removal system, e.g., electrostatic precipitators followed by bag filters, must collect $CaSO_4$ particles in addition to flyash. Present systems are capable of removing approximately 99.5% of the particulates in flue gas. The question therefore arises as to how much ash can be present in the input fuel without exceeding emission standards, taking into account the fact that $CaSO_4$ particles contribute to the particulates which must be removed.

In most modern power plants burning powdered coal fuel, approximately 80% of the ash originally present in the coal becomes fly ash.

Assuming: (1) 99.5% of all particulates are removed from the flue gases before release to the atmosphere, and (2) 80% of the ash present in the original coal becomes fly ash, and (3) all of the $CaSO_4$ produced becomes particulates in the flue gas leaving the furnace, then the maximum permissable ash content of the lime/coal fuel can be calculated and is as shown in Table 3.

TABLE 3.

Maximum permissable ash content in lime/coal fuel, to avoid exceeding particulates emission standard of 0.1 lb/million Btu.

Basis: (1) 99.5% particulate removal
(2) 80% of ash in coal becomes fly ash
(3) all $CaCO_4$ becomes particulates to be removed
(4) coal contains max. permissable sulfur
(5) stoichiometric amount of $CaSO_4$ is produced

| heating value of coal, Btu/lb | Max. ash content, for $SO_2$ removal efficiency of: 50% | 60% | 70% | 80% | 90% |
|---|---|---|---|---|---|
| 7000 | 13.25 | 12.40 | 10.95 | 7.90 | * |
| 8000 | 14.85 | 13.92 | 12.32 | 8.92 | * |
| 9000 | 16.41 | 15.39 | 13.65 | 9.93 | * |
| 10,000 | 17.91 | 16.82 | 14.94 | 10.91 | * |
| 11,000 | 19.35 | 18.19 | 16.19 | 11.89 | * |
| 12,000 | 20.74 | 19.53 | 17.41 | 12.82 | * |
| 13,000 | 22.09 | 20.81 | 18.59 | 13.74 | * |
| 14,000 | 23.39 | 22.05 | 19.74 | 14.64 | * |

*means standard cannot be met, given basis specified.

To obtain some perspective of the formulation that could be used in practicing the present invention, and its importance to the utility industry, Table 4 provides an indication of the coal product characteristics that can reasonably be expected from a typical present-day coal preparation plant.

TABLE 4.

Typical enhancement of coal quality by current commercial beneficiation practice.

| Coal Source | Coal Characteristic | Before Beneficiation | After Beneficiation |
|---|---|---|---|
| Northern Appalachian | ash, % | 17.7 | 7.4 |
| | sulfur, % | 2.98 | 1.96 |
| | Btu/lb | 11,120 | 12,821 |
| Southern Appalachian | ash, % | 14.2 | 4.3 |
| | sulfur, % | 0.90 | 0.81 |
| | Btu/lb | 12,330 | 14,030 |

Considering, for example, the N. Appalachian beneficiated product as the coal to be used in compounding a lime/coal mixture, Table 1 indicates that an in-furnace sulfur removal efficiency of 60% or better would have to be achieved; Table 2 indicates that the stoichiometric amount of lime required is about 2%; and Table 3 implies that about 7% fly ash (or other pozzolonic material) could be added as additional binder material if needed or desired.

A 60% in-furnace sulfur capture is almost certainly realizable with a small excess of lime, so that, with this coal, one might want to use a formulation corresponding to 3% lime, 4–5% fly ash, 92–93% powdered coal. The important point is that by adding less than 10% low-cost materials as binder, a 3% sulfur N. Appalachian coal can be rendered easily transportable and widely usable as a fuel meeting air quality standards without the capital and operating costs of flue gas scrubbing.

What is claimed is:

1. A method for the preparation of a coal composition consisting essentially of the steps of:

(a) mixing (1) powdered coal with (2) a lime component selected from the group consisting of lime, limestone, dolomite and mixtures thereof, and (3) flyash as a pozzolonic component, to obtain substantially uniform dispersal of the lime and flyash components throughout the coal, water being added if required to obtain a mix or workable consistency;

(b) working the mix to obtain a homogeneous and uniform dispersion of the lime and flyash components with the coal particles; and (c) forming and drying the resulting mixture into solid product shapes suitable for burning; the resulting coal composition being suitable for handling, transporting, and burning.

* * * * *